US005393387A

United States Patent [19]

Mikami et al.

[11] Patent Number: 5,393,387

[45] Date of Patent: Feb. 28, 1995

[54] METHOD FOR TREATING ETCHANT

[75] Inventors: Yasuie Mikami, Tokyo; Masaaki Iosaki, Mitaka; Masao Shibasaki, Tokyo, all of Japan

[73] Assignee: Nittetsu Mining Co., Ltd., Tokyo, Japan

[21] Appl. No.: 960,992

[22] Filed: Oct. 14, 1992

[30] Foreign Application Priority Data

Oct. 28, 1991 [JP] Japan ..... 3-281370
Nov. 8, 1991 [JP] Japan ..... 3-293127

[51] Int. Cl.[6] ..... C25C 1/12

[52] U.S. Cl. ..... 204/106; 204/107; 204/112; 204/113; 204/151

[58] Field of Search ..... 204/106, 107, 112, 113, 204/151; C25C 1/12

[56] References Cited

U.S. PATENT DOCUMENTS

| | | | |
|---|---|---|---|
| 3,761,369 | 9/1973 | Tirrell | 204/151 |
| 3,794,571 | 2/1974 | Beyer et al. | 204/94 |
| 4,508,599 | 4/1985 | Ott et al. | 204/106 |
| 4,604,175 | 8/1986 | Naumov et al. | 204/151 |

FOREIGN PATENT DOCUMENTS

| | | | |
|---|---|---|---|
| 51-119632 | 10/1976 | Japan . | |
| 55-018558 | 2/1980 | Japan | 204/106 |
| 55-145175 | 11/1980 | Japan . | |
| 56-17429 | 4/1981 | Japan . | |
| 57-29560 | 6/1982 | Japan . | |
| 61-246395A | 11/1986 | Japan | G25C 1/120 |
| 2-254188 | 10/1990 | Japan . | |

OTHER PUBLICATIONS

Chemical Abstracts, vol. 91, No. 22, abstract #183813p, p. 563 (1979).

Chemical Abstracts, vol. 108, No. 12, abstract #98357t, p. 246 (1988).

Research Disclosure, vol. 321, No. 04, 1 Jan. 1991, Emsworth, XP000163405, Anonymus 'Parallel Chemical Recovery and Copper Regeneration System' whole document.

Soviet Inventions Illustrated, Section CH, Week 8413, 9 May 1984 Derwent Publications Ltd., London, GB; Class L03, AN 84-080088/13 & SU-A-1 019 681 (Nikulik B. A.) abstract.

Patent Abstracts of Japan, vol. 5, No. 16 (C-41) (688) 30 Jan. 1981; JP-A-55 145 176 (Kagaku Gijutsu Shinkoukai abstract.

JOM, vol. 43, No. 8, pp. 60-65, Aug. 1991, "The Electrowinning of Copper from a Cupric Chloride Solution", by H. K. Lin et al.

EPD Congress 1991, pp. 45-62, TMS Annual Meeting: New Orleans, La., "Fundamental Aspects in Electrowinning of Copper from Cupric Chloride Solution", by H. K. Lin et al.

EPD Congress 1991, pp. 27-43, TMS Annual Meeting: New Orleans, La., "Laboratory Investigation on Electrowinning of Copper from Cupric Chloride Solution", by X. J. Wu et al.

Proc. 1st Int. Conf. Hydrometall. 1988, pp. 604-608, 1989 International Conference on Hydrometallurgy (1st) Beijing.

Transactions of the Indian Institute of Metals, vol. 37, No. 2, pp. 156-158, Apr. 1984, "Production of Copper Powder Using Cuprous Chloride electrolyte", by Arvind Swaroop et al.

Chloride Electrometall., pp. 203-220, 1982, "Chronopotentiometric Studies of Opper Deposition from Chloride Electrolytes", by Vasilios Karabinis et al.

Chloride Electrometall., pp. 189-202, 1982, "Copper Electrowinning in Chloride Aqueous Solutions", by Luc Albert et al.

TMS Paper Selection (Metall. Soc. AIME), No. A8-2-26, 1932, "Copper Electrowinning in Chloride Aqueous Solutions", by Luc Albert et al.

*Primary Examiner*—John Niebling
*Assistant Examiner*—Arun S. Phasge
*Attorney, Agent, or Firm*—Jordan and Hamburg

[57] ABSTRACT

In order to ensure an easy operation, a decreased cost in maintenance and installation, and a safe and effective use of chlorine gas generated in a closed system, a new method for treating an etchant is offered. The method comprises the following steps of; (1) treating an etchant including copper (I) chloride or ferric chloride containing copper by means of an electrolysis using a diaphragm to withdraw copper electrolytically deposited in a cathode cell, (2) supplying chlorine gas generated in an anode cell into another etchant used in an etching process, thereby enabling the etchant to be regenerated.

12 Claims, 1 Drawing Sheet

METHOD FOR TREATING ETCHANT

BACKGROUND OF THE INVENTION

This invention relates to a method for treating an etchant, more specifically a method for treating an etchant including copper (I) chloride or ferric chloride containing copper, in which case, chlorine gas generated therein is used to treat other etchants for the regeneration.

It is generally known that a conductive pattern of e.g., an integrated circuit in a substrate is manufactured by solving copper in areas other than those corresponding to conducting lines to be used with the aid of a solution of copper (II) chloride ferric chloride.

It is desirable to regenerate the waste of etchant and thus to reuse it for other etching Processes from the view point of avoiding the environmental pollution and economic requirements, where the etchant waste contains copper (I) chloride produced in the following etching process:

$$CuCl_2 + Cu \rightarrow 2CuCl,$$

or the waste is generated from the etching process in which the solution of ferric chloride is used. Several methods have been proposed for regenerating the etchant waste, where copper is withdrawn from the waste and then the etchant is regenerated. Some of the methods have already been applied to practical use.

In one of the most typical methods for regenerating the waste of etchant containing copper (I) chloride, CuCl in the waste is regenerated into copper (II) chloride $CuCl_2$ with the aid of hydrochloric acid and hydrogen peroxide.

In this method, however, all contents of copper dissolved from the copper foil of the substrate into the etching solution are stored as copper (II) chloride $CuCl_2$, thereby rapidly giving rise to an excess concentration of $CuCl_2$.

Accordingly, an excess amount of etchant is usually supplied to a disposal tank in a factory of etching and, therefore, there is a danger of pollution which eventually occurs in the course of the disposal process of the excess etchant or its transportation.

In spite of the above-mentioned treatment with hydrogen peroxide, an improvement for etching has been proposed where the etchant waste is electrolytically treated, so that the etchant is regenerated by changing copper (I) chloride CuCl into copper (II) chloride $CuCl_2$ with the aid of chlorine generated at the side of the anode in which the waste is transported, and at the same time copper can be electrolytically withdrawn from deposited copper ions as metallic copper at the side of the cathode in which the waste is similarly transported. This method has been disclosed in the Japanese Patent Publication Sho 56-17429, and has already been applied to practical uses.

In this patent publication, the proper adjustment of liquid phase composition in the cathode cell of an electrolytic bath is particularly recommended.

In the method for withdrawing copper on the basis of the electrolytic process according to the Japanese Patent Publication Sho 56-17429, however, complicated operations are required for controlling the liquid phase composition, the respective flow rates of solution supplied to the cathode and anode cells, the balance in pressure, etc, because the liquid phase composition must be kept at a reduced copper concentration of less than 65 g/l for the composite solution of both copper (I) and copper (II) chlorides, under the conditions that the etchant waste is separately supplied into the cathode and anode cells. Moreover, no explicit description is given on the method for treating chlorine gas to be generated; without the treatment, a danger of deteriorating the working environment increases due to the generated chlorine gas.

Moreover, as for the etchant waste resulting from the etching process with a solution of ferric chloride, an electrolytic process is Particularly well known, in which the etchant waste is decomposited in an electrolytic bath having a diaphragm between the anode and cathode cells, so that metallic copper can be obtained from copper ions deposited onto the cathode, and at the same time the ferric chloride can be regenerated by oxidation at the side of the anode.

In such an electrolytic process, the etching solution after the dissolution of copper plates or copper foils in a printed circuit board contains trivalent iron ions, divalent iron ions, divalent copper ions and monovalent copper ions which result from ferric chloride and copper foils. In the course of electrolysis for such an etchant, the reactions of electrolytic reduction occur at the cathode of the electrolytic bath in the following sequence:

$$Fe^{3+} + e^- \rightarrow Fe^{2+},$$

and then, $$Cu^{2+} + 2e^- \rightarrow Cu^+ \rightarrow Cu.$$

In other words, ferric chloride is first reduced to ferrous chloride in the solution, and then copper (II) chloride is reduced to copper (I) chloride, thereafter a copper metal is deposited. If, therefore, the electrolysis is continuously performed with a closely circulated apparatus for withdrawing, and at the same time if a part of copper metal deposited onto the cathode, in particular powder of metallic copper fallen out of the surface of the cathode into the solution remains at the bottom, $FeCl_3$ or $CuCl_2$ which is newly supplied into the etchant reacts as follows:

$$FeCl_3 + Cu \rightarrow FeCl_2 + CuCl$$

$$CuCl_2 + Cu \rightarrow 2CuCl.$$

Accordingly, the copper which has once been deposited is again dissolved into the solution, thereby reducing the efficiency of copper recovery. In addition, the dissolution provides a considerable amount of CuCl in the regenerated solution. These drawbacks eventually result in a decreased efficiency of etching.

Taking into account these facts, the Japanese Patent Publication Sho 55-18558 has disclosed a method for continuously withdrawing copper by electrolysis of the etchant waste including ferric chloride containing copper and for regenerating the etchant of ferric chloride, in which case the electrolytic reduction process is divided into two steps: In the first step, ferric chloride and copper (II) chloride are reduced to ferrous and copper chlorides, respectively, and, in the second step, metallic copper is deposited.

In the method for withdrawing copper by electrolysis according to the above-mentioned patent publication, however, there are drawbacks due to the complicated installation which permits the reduction of the etchant to be performed just before the electrolytic deposition of copper occurs in the first step, and also due to the difficulty in controlling the liquid phase composition. In addition, similar to the Japanese Patent Publication Sho 56-17429, the method for treating the chlorine gas to be generated is not described. Therefore, there is a danger of deteriorating the working environment due to the resultant gas of chlorine.

Incidentally, if one is restricted only to withdrawing metallic copper from the etchant waste, it is possible to use so called cementation in which iron powder is put into the waste, thereby enabling copper to be reduced on account of the difference in ionization tendency. However, cementation provides an excess content of iron in the solution treated, reuse of the etchant is impossible and the used etchant is abandoned. As a result, this method cannot assure avoidance of pollution in the environment, nor of economic requirements.

SUMMARY OF THE INVENTION

Accordingly, the object of this invention is to offer a method for treating an etchant in a one stage electrolytic process, in order to avoid various problems which are said to occur, in a closed system, as well as the drawbacks of the above-mentioned methods in the prior art, thereby ensuring ease of operation, a decreased cost in maintenance and installation, and a safe and effective use of chlorine gas generated by the system.

Another object of this invention is to regenerate an etching waste with a high efficiency as well as to withdraw copper having a purity of more than 90% from the waste by employing both electrolysis with a diaphragm cell and oxidation with chlorine gas.

Another object of this invention is to provide an easy and reliable adjustment in supplying the etchant waste into only the cathode cell of an electrolytic bath, in contrast to the prior method in which the etchant waste is supplied to both cathode and anode cells.

In accordance with this invention, the objects are attained by a method wherein the etchant including copper (I) chloride or ferric chloride containing copper is treated by the electrolytic process with a diaphragm, so that etchant waste is regenerated by electrolytically depositing copper on the cathode surface in the cathode cell, and at the same time, by introducing a chlorine gas generated in the anode cell into another etchant used in the etching process.

The fundamental concept of this invention is that the etchant waste is treated by means of both electrolysis with a diaphragm cell and oxidation with chlorine gas. Especially, all the chlorine gas generated in the anode cell is used, so that the etchant can be regenerated without loss.

The method of oxidation with chlorine gas has been regarded merely as an unverified method of regeneration, as pointed out in the Japanese Patent Laid Open Hei 2-254188. However, the present inventors succeeded in confirming its utilizability as well as in overcoming "the problems of environmental hygiene" by employing a closed electrolytic bath accompanied with an absorbing tower, the electrolytic bath being developed for realizing the present method.

The process according to the present invention is now described in detail:

It is advantageous that the process for regenerating the etchant consists of a first step at which the etchant including copper (I) chloride or ferric chloride is supplied to the cathode cell of an electrolyzer for withdrawing metallic copper, a second step at which the etchant after the removal of copper is then conducted to the anode cell in order to oxidize monovalent copper ions into divalent copper ions, together with the generation of chlorine gas, and a third step at which the chlorine gas thus generated is supplied to another etchant to oxidize it.

As another embodiment, it is also advantageous that the process consists of a first step at which the etchant is supplied to the cathode cell of an electrolyzer for withdrawing metallic copper, a second step at which the etchant after the removal of copper is further supplied to another etchant to form a mixture solution, and a third step at which the chlorine gas generated at the first step is supplied to the mixture solution to oxidize it.

In order to realize the closed system for withdrawing copper in a single stage (such a system has not yet been realized so far), it is necessary that the etchant including ferric chloride containing copper is regulated to be kept at trivalent iron ion and copper ion concentrations of less than 30 g/l and 20 g/l, respectively, in the cathode solution.

The electrolytic diaphragm used in the present invention must possess the following properties: (1) restrict mobility of complex salts of copper or iron chlorine in the cathode cell towards the anode cell and isolate the solutions in the anode and cathode so as to prevent mixture of them even during a certain amount of vibration in the surface of the solution, (2) a value of electrical resistivity as small as possible, (3) agent-proof, in particular against chlorinating, and (4) no polarity in the diaphragm itself, i.e., electrically neutral and no dipole therein. Such a diaphragm can be prepared from modoacrylic, vinyl acetate, polyester, vinylidene chloride, or the like.

The anode in the electrolytic bath must be able to decrease the overvoltage during generation of chlorine gas. Advantageously, it can be prepared from platinum or a dimensional stable anode (denoted by DSA), such as $(Ru\text{-}Sn)O_2/Ti$, $(Ir\text{-}Pt)O_2/Ti$. As a cathode, titanium can preferably be used. The utilization of the electrodes thus specified provides copper crystals which are unresolvable into the solution and which can be easily exfoliated from the surface of the electrode.

In accordance with the present invention, the etchant generated in the etching bath, i.e., the etching solution including copper (I) chloride and unreacted copper (II) chloride or the etching solution including trivalent iron ions, divalent iron ions, divalent copper ions and monovalent copper ions is initially transported to the cathode cell in the electrolyzer. And then, inside the cathode cell in which a circulated cathode solution comes in and out, trivalent iron ions are reduced into divalent iron ions, after that excess divalent copper ions and monovalent copper ions are reduced and deposited on the electrode, thus enabling metallic copper to be withdrawn.

The solution leaving the cathode cell with a decreased copper concentration is now apart from the circulating system, and then conducted to the anode cell, where chlorine ions lose their own electrons so that chlorine gas generates. The chlorine gas is supplied to an absorbing tower. The solution, which has a decreased concentration of chlorine due to the generation of chlorine gas at the same time monovalent copper ions are electrolytically oxidized into divalent copper ions, is apart from the circulating system at the anode, and then returns to the etching bath as a regenerated etchant.

The etchant generated in the etching bath, i.e., the etchant including copper (I) chloride and unreacted copper (II) chloride or the etchant including trivalent iron ions, divalent iron ions, divalent copper ions and monovalent copper ions is supplied to not only to the electrolyzer, but also to the absorbing tower. With the aid of the chlorine gas which generates at the electrolyzer and then is supplied to the absorbing tower, the etchant including copper (I) chloride and unreacted copper (II) chloride is oxidized for regeneration according to the following reaction, $$2CuCl + Cl_2 \rightarrow 2CuCl_2.$$

The copper (II) chloride thus regenerated is returned as a regenerated etchant to the etching bath.

The etchant including trivalent iron ions, divalent iron ions, divalent copper ions and monovalent copper ions is oxidized for regeneration according to the following reaction equations, $$2FeCl_2 + Cl_2 \rightarrow 2FeCl_3,$$

$$2CuCl + Cl_2 \rightarrow 2CuCl_2.$$

The solution of both regenerated copper (II) chloride and ferric chloride is returned as a regenerated etchant to the etching bath.

The solution which is reduced at a decreased copper concentration in the cathode cell and then leaves the cell, can also be supplied directly to the etchant conducted to the absorbing tower. In this case, chlorine ions and copper chlorine complexes, which travel towards the anode, passing through the diaphragm in the electrolytic bath, are oxidized, hence generating the chlorine gas. The etchant thus mixed is regenerated by introducing the chlorine gas into the absorbing tower, and thus returned as a regenerated etchant to the etching bath.

In the conventional electrolytic method, the generation of chlorine gas is preferably as small as possible. It must be noted, however, that in the present invention the chlorine gas is positively used in order to regenerate the etchant in a completely closed system.

Furthermore, it must be mentioned that the conversion of copper (I) chloride into copper (II) chloride and/or of copper (I) chloride and ferrous chloride into copper (II) chloride and ferric chloride is often needed and the treating method according to the invention is particularly useful in various fields of the technology, aside from application to the field of circuit boards, since it provides no problems in environmental pollution.

DETAILED DESCRIPTION OF PREFERRED EMBODIMENTS

This invention will further be described below with the aid of the figures.

Example 1

Figure 1:
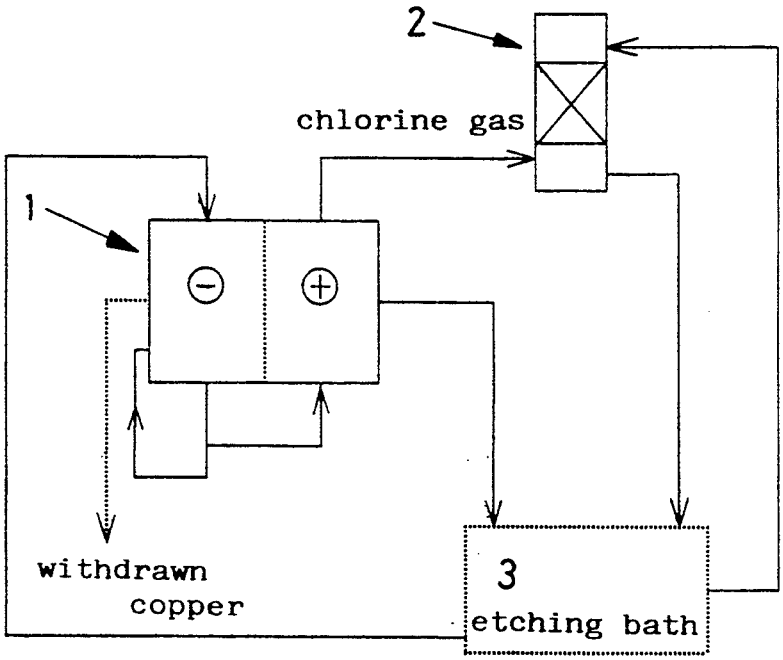
FIG. 1 is a conceptual flow chart in the first embodiment of this invention.

In an apparatus which is conceptually illustrated in FIG. 1, an etchant having a copper content of 121 g/l (8.6 g/l for monovalent copper ions) and a chlorine content of 300 g/l was supplied at a flow rate of 9.6 ml/min to a cathode cell (electrode; Cu) in an electrolyzer 1 having a modoacryl diaphragm, where the bath was operated at an electrolytic voltage of 2.1 DC V. In the cathode cell where a circulated cathode solution came in and went out, excess monovalent and divalent copper ions were electrolytically deposited after reduction. The chemical analysis showed that the deposited metal had a copper content of 93.9%. The production rate of withdrawn copper was 51.7 g/h and the power necessary for the electrolysis per 1 g copper was 2.03 Wh/g.

The solution which left the cathode cell having a decreased concentration of copper was transferred from the circulation system to an anode cell (electrode; $(Ru\text{-}Sn)O_2/Ti$). In the anode cell, chlorine ions lost their own electron, so that chlorine gas was generated at a rate of 66.2 g/h. The gas was supplied to absorbing tower 2. The solution in the circulating system at the anode had a decreased concentration of chlorine due to the generation of chlorine gas. Thus, the solution was electrolytically oxidized in such a way that monovalent copper ions changed to divalent copper ions. The solution extracted from the circulation system had a copper content of 30.8 g/l (0.0 g/l for monovalent copper ions) and a chlorine content of 185 g/l, and was returned as a regenerated etchant to etching bath 3.

The etching solution generated in etching bath 3 had a copper content of 121 g/l (8.6 g/l for monovalent copper ions) and a chlorine content of 300 g/l. The etchant was supplied not only to the electrolyzer 1 having the diaphragm, but also to the absorbing tower at a flow rate of 200 ml/min. The etchant was oxidized by the chlorine gas which was initially generated at electrolyzer 1 and then supplied to absorbing tower 2. The resultant solution had a copper content of 121 g/l (0.0 g/l for monovalent copper ions) and a chlorine content of 304 g/l. Therefore, it was confirmed that the solution obtained was generated as a solution including copper (II) chloride. This solution was returned as a regenerated etchant to etching bath 3.

Example 2

In an apparatus which is conceptually illustrated in FIG. 1, an etchant having a copper content of 87.4 g/l (0.0 g/l for monovalent copper ions), an iron content of 100 g/l (23.4 g/l for divalent iron ions) and a chlorine content of 317 g/l was first supplied at a flow rate of 4.1 ml/min to a cathode cell (electrode; Cu) in electrolyzer 1 having a modoacryl diaphragm, where the bath was operated at an electrolytic voltage of 2.1 DC V. A circulated solution at the cathode cell had a copper content of 13.3 g/l, an iron content of 104.8 g/l and a chlorine content of 273 g/l, where it was kept at a trivalent iron ion concentration of less than 30 g/l. In the cathode cell where the circulated solution came in and went out, the trivalent iron ions were electrolytically reduced to divalent iron ions, and then excess divalent and monovalent copper ions were electrolytically reduced, thereby being deposited onto the surface of the cathode. The chemical analysis showed that the metal deposited had a copper content of 97.1%. The production rate of withdrawn copper was 17.3 g/h and the power necessary for electrolysis per 1 g copper was 3.64 Wh/g.

The solution which left the cathode cell in a decreased concentration of copper was transferred from the circulation system to an anode cell (electrode; (Ru-Sn)$O_2$/Ti). In the anode cell, chlorine ions lost their own electron, so that chlorine gas was generated at a rate of 6.3 g/h. The gas was guided to absorbing tower 2. The solution in the circulation system at the anode decreased the concentration of chlorine due to the generation of chlorine gas, thereby being electrolytically oxidized in such a way that divalent iron ions and monovalent copper ions changed to trivalent iron ions and divalent copper ions, respectively. The solution extracted from the circulation system had a copper content of 15.7 g/l (0.0 g/l for monovalent copper ions), an iron content of 104 g/l (0.0 g/l for divalent iron ions) and a chlorine content of 247 g/l, and was returned as regenerated etchant to etching bath 3.

The etching solution generated in etching bath 3 had a copper content of 37.5 g/l (0.0 g/l for monovalent copper ions), an iron content of 106 g/l (51.4 g/l for divalent iron ions) and a chlorine content of 248 g/l. The etchant was supplied at a flow rate of 2.3 ml/min to absorbing tower 2. The etchant was oxidized by the chlorine gas which initially generated at the electrolyzer 1 and then supplied to absorbing tower 2. The resultant solution had a copper content of 37.5 g/l (0.0 g/l for monovalent copper ions), an iron content of 106 g/l (0.0 g/l for divalent iron ions) and a chlorine content of 292 g/l (11.4 g/l for dissolved chlorine). Therefore, it was confirmed that the solution obtained was generated as a solution including copper (II) chloride and ferric chloride. This solution was returned as a regenerated etchant to etching bath 3.

Example 3

Figure 2:
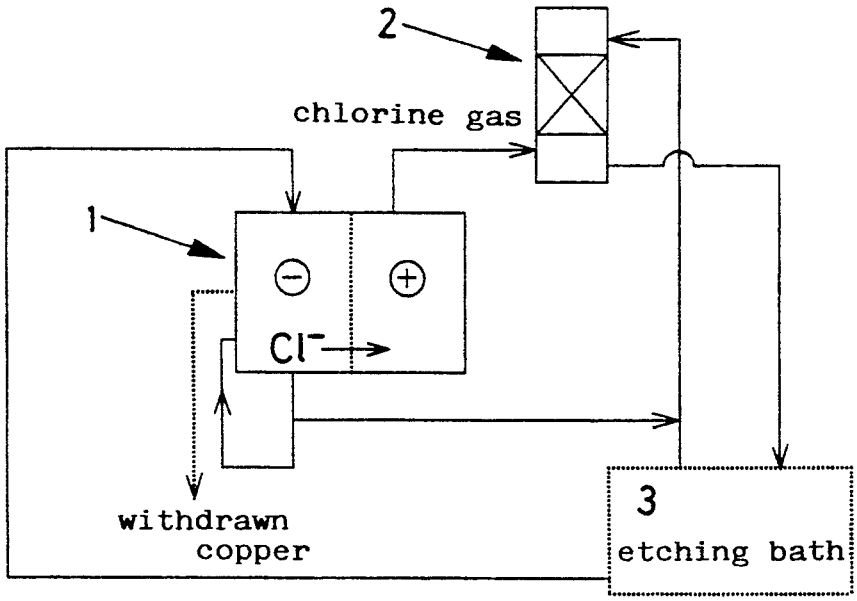
FIG. 2 is a conceptual flow chart in another embodiment of this invention.

In an apparatus which is conceptually illustrated in FIG. 2, an etchant having a copper content of 121 g/l (8.9 g/l for monovalent copper ions) and a chlorine content of 302 g/l was first supplied at a flow rate of 8.33 ml/min to a cathode cell (electrode; Cu) in electrolyzer 1 having a modoacryl diaphragm. The electrolytic bath was operated at an electrolytic voltage of 2.0 DC V. In the cathode cell where a circulated cathode solution came in and went out, excess monovalent and divalent copper ions were electrolytically deposited after reduction. The chemical analysis showed that the deposited metal had a copper content of 97.5%. The production rate of withdrawn copper was 45.1 g/h and the power necessary for the electrolysis per 1 g copper was 2.3 Wh/g.

The solution which left the cathode cell having a decreased concentration of copper was mixed with another etchant including a copper content of 121 g/l (14.2 g/l for monovalent copper ions) and a chlorine content of 302 g/l, this etchant being generated in etching bath 3. The mixed solution including a copper content of 117 g/l (14.5 g/l for monovalent copper ions) and a chlorine content of 297 g/l was supplied at a flow rate of 100 ml/min to absorbing tower 2.

In an anode cell (electrode; (Ru-Sn)$O_2$/Ti) of electrolyzer 1 having the diaphragm, chlorine ions which were generated in the cathode cell and flowed into the anode cell through the diaphragm were oxidized, thus generating chlorine gas at a rate of 59.7 g/h. The chlorine gas generated was introduced into absorbing tower 2.

The mixed solution was oxidized by the chlorine gas. The resultant solution had a copper content of 117 g/l (0.0 g/l for monovalent copper ions) and a chlorine content of 304 g/l. It was confirmed that the solution obtained was generated as a solution including copper (II) chloride. This solution was returned as a regenerated etchant to etching bath 3.

Example 4

In an apparatus which is conceptually illustrated in FIG. 2, an etchant having a copper content of 89.5 g/l (0.0 g/l for monovalent copper ions), an iron content of 99.1 g/l (15.7 g/l for divalent iron ions) and a chlorine content of 318 g/l was first supplied at a flow rate of 4.6 ml/min to a cathode cell (electrode; Cu) in electrolyzer 1 having a modoacryl diaphragm, where the bath was operated at an electrolytic voltage of 2.6 DC V. A circulated solution at the cathode cell had a copper content of 6.8 g/l, an iron content of 100 g/l and a chlorine content of 239 g/l, where it was kept at a trivalent iron ion concentration of less than 30 g/l. In the cathode cell where the circulated solution came in and went out, the trivalent iron ions were electrolytically reduced to divalent iron ions, and then excess divalent and monovalent copper ions were electrolytically reduced, thereby being deposited onto the surface of the cathode. The chemical analysis showed that the metal deposited had a copper content of 96.6%. The production rate of withdrawn copper was 22.7 g/h and the power necessary for electrolysis per 1 g copper was 4.58 Wh/g.

The solution which left the cathode cell having a decreased concentration of copper was mixed with another etchant having a copper content of 121 g/l (14.2 g/l for monovalent copper ions) and a chlorine content of 302 g/l, this etchant being generated in etching bath 3. The mixed solution having a copper content of 36.6 g/l (0.0 g/l for monovalent copper ions), an iron content of 104 g/l (19.3 g/l for divalent iron ions) and a chlorine content of 271 g/l was supplied at a flow rate of 17.3 ml/min to absorbing tower 2.

In an anode cell (electrode; (Ru-Sn)$O_2$/Ti) of electrolyzer 1 having the diaphragm, chlorine ions were generated into the cathode cell and flowed in the anode cell through the diaphragm were oxidized, thus generating chlorine gas at a rate of 21.8 g/h. The chlorine gas generated was introduced into absorbing tower 2.

The mixed solution was oxidized by the chlorine gas. The resultant solution had a copper content of 36.6 g/l (0.0 g/l for monovalent copper ions), an iron content of 104 g/l (0.0 g/l for divalent iron ions) and a chlorine content of 292 g/l (8.7 g g/l for dissolved chlorine). It was confirmed that the solution obtained was generated as a solution including copper (II) chloride and ferric chloride. This solution was returned as a regenerated etchant to etching bath 3.

What is claimed is:

1. A method for regenerating a waste etchant comprising obtaining a first waste etchant from an etching bath, said first waste etchant including copper (I) chloride; treating said first waste etchant in an electrolytic bath, having a diaphragm between a cathode and an anode, said diaphragm being electrically neutral, nonpolar and having a low resistivity for enabling operation of said electrolytic bath at a minimal voltage, said treating including introducing said first waste etchant to the cathode; maintaining a concentration of copper ions of less than 20 g/l at said cathode; withdrawing copper electrolytically deposited on the cathode, thereby reducing an amount of copper in said first waste etchant; supplying said first waste etchant, having a reduced amount of copper, to the anode, thereby regenerating said first waste etchant by oxidizing copper ions and, thereby, generating chlorine gas; supplying said chlorine gas, generated in said anode, to an absorbing tower; introducing a second waste etchant from said etching bath to said absorbing tower, said second waste etchant including copper (I) chloride; regenerating said second waste etchant using said chlorine gas for regenerating said second waste etchant by oxidizing copper ions in said second waste etchant; and supplying said first and second regenerated etchants to said etching bath.

2. A method for regenerating a waste etchant according to claim 1, wherein said minimal voltage is selected from the group consisting of 2.0 V and 2.1 V.

3. A method for regenerating a waste etchant according to claim 1, wherein an amount of power required to withdraw 1 Kg of copper is selected from the group consisting of 2.03 kWh and 2.3 kWh.

4. A method for regenerating a waste etchant according to claim 1, wherein said diaphragm is formed of a material selected from the group consisting of a modacrylic, vinyl acetate, polyester and vinylidene chloride.

5. A method for regenerating a waste etchant according to claim 1, wherein the withdrawn copper has a purity of greater than 90%.

6. A method for regenerating a waste etchant comprising obtaining a first waste etchant from an etching bath, said first waste etchant including copper (I) chloride; treating said first waste etchant in an electrolytic bath, having a diaphragm between a cathode and an anode, said diaphragm being electrically neutral, nonpolar and having a low resistivity for enabling operation of said electrolytic bath at a minimal voltage, said treating including introducing said first waste etchant to the cathode; maintaining a concentration of copper ions of less than 20 g/l at said cathode; withdrawing copper electrolytically deposited on the cathode, thereby reducing an amount of copper in said first waste etchant; supplying chlorine ions and copper chlorine complexes from said cathode to said anode, thereby generating chlorine gas; introducing said chlorine gas to an absorbing tower; mixing said first waste etchant, having a reduced amount of copper, and a second waste etchant, including copper (I) chloride, from said etching bath, to form a mixture; supplying said mixture to said absorbing tower; regenerating said mixture using said chlorine gas for oxidizing copper ions in said mixture; and supplying said regenerated mixture to said etching bath.

7. A method for regenerating a waste etchant according to claim 6, wherein said minimal voltage is selected from the group consisting of 2.0 V and 2.1 V.

8. A method for regenerating a waste etchant according to claim 6, wherein an amount of power required to withdraw 1 Kg of copper is selected from the group consisting of 2.03 kWh and 2.3 kWh.

9. A method for regenerating a waste etchant according to claim 6, wherein said diaphragm is formed of a material selected from the group consisting of a modacrylic, vinyl acetate, polyester and vinylidene chloride.

10. A method for regenerating a waste etchant according to claim 6, wherein the withdrawn copper has a purity of greater than 90%.

11. A method for regenerating a waste etchant according to claim 1, wherein said first waste etchant and said second waste etchant further includes ferric chloride; further comprising maintaining a concentration of trivalent iron ions of less than 30 g/l at said cathode; oxidizing iron ions at said anode for regenerating said first waste etchant; and oxidizing iron ions in said absorbing tower, using said chlorine gas, for regenerating said second waste etchant.

12. A method for regenerating a waste etchant according to claim 6, wherein said first waste etchant and said second waste etchant further includes ferric chloride; further comprising maintaining a concentration of trivalent iron ions of less than 30 g/l at said cathode; and oxidizing iron ions in said absorbing tower, using said chlorine gas, for regenerating said mixture.

* * * * *